US009790049B2

(12) United States Patent
Kobashi

(10) Patent No.: US 9,790,049 B2
(45) Date of Patent: Oct. 17, 2017

(54) DEVICE FOR TRANSFERRING COATED FILM

(71) Applicant: PLUS Corporation, Tokyo (JP)

(72) Inventor: Yoshihiko Kobashi, Tokyo (JP)

(73) Assignee: PLUS Corporation, Tokyo (JP)

( * ) Notice: Subject to any disclaimer, the term of this patent is extended or adjusted under 35 U.S.C. 154(b) by 162 days.

(21) Appl. No.: 14/754,611

(22) Filed: Jun. 29, 2015

(65) Prior Publication Data

US 2016/0009520 A1 Jan. 14, 2016

(30) Foreign Application Priority Data

Jul. 9, 2014 (JP) ..... 2014-141825

(51) Int. Cl.

| | |
|---|---|
| ***B29C 65/50*** | (2006.01) |
| ***B32B 37/14*** | (2006.01) |
| ***B32B 37/26*** | (2006.01) |
| ***B32B 41/00*** | (2006.01) |
| ***B65H 37/00*** | (2006.01) |

(52) U.S. Cl.
CPC ..... *B65H 37/007* (2013.01)

(58) Field of Classification Search
USPC ..... 156/537, 540, 543, 556
See application file for complete search history.

(56) References Cited

U.S. PATENT DOCUMENTS

2003/0062135 A1* 4/2003 Takahashi ..... B44C 1/105 156/577

FOREIGN PATENT DOCUMENTS

JP 2011-121202 6/2011 ..... B43L 19/00

OTHER PUBLICATIONS

Machine translation of JP 2011-121202 (Feb. 8, 2017).*

* cited by examiner

*Primary Examiner* — Sing P Chan
(74) *Attorney, Agent, or Firm* — Martine Penilla Group, LLP

(57) ABSTRACT

To provide a device for transferring a coated film in which a transfer unit can be protected well enough, a lid is not obstructive during the use of the device, and costs of production can be kept low. The device for transferring a coated film includes a hollow case having an opening formed therein. The case contains a sliding member 200 on which a first spool 300 for feeding a length of tape and a second spool 400 for taking up the tape are supported by their respective shafts, the sliding member 200 including a transfer unit 250 for transferring the tape. A control piece 220, which is a part of the sliding member 200, is exposed outside of the case through a guide slot formed in the case. The opening is opened and closed using a lid 500. When the control piece 220 is pushed ahead, the lid 500 is rotated and housed in the case. The transfer unit is moved to the outside of the case through the opening which is not covered with anything.

8 Claims, 8 Drawing Sheets

DEVICE FOR TRANSFERRING COATED FILM

CLAIM OF PRIORITY TO RELATED APPLICATION

The application claims priority from Japanese Patent Application No. 2014-141825 filed Jul. 9, 2014, the disclosure of which is incorporated herein by reference in its entirety.

BACKGROUND OF THE INVENTION

Technical Field

The present invention relates to devices for transferring a coated film releasably disposed on one side of a tape to a desired surface.

Background Art

Devices for transferring a coated film, which are used for transferring a coated film releasably disposed on one side of a strip of tape to a desired surface, have practically been used. The film may be a coating of, for example, collection fluid or adhesive. The devices for transferring a coated film are thus used as a correction tape transfer device when the coated film is a correction fluid film. Likewise, they are used as an adhesive transfer device when the coated film is an adhesive film. Other devices for transferring a coated film have also been used with various tapes for a variety of purposes such as transfer devices used in combination with decoration tapes and marking tapes.

Devices for transferring a coated film usually include a first spool, a transfer unit and a second spool which are attached to a casing or a case. The first spool is for holding a length of tape to be fed therefrom. The transfer unit is for transferring a coated film on the tape fed from the first spool to a desired surface. The second spool is for taking up a "used" tape after being passed through the transfer unit.

The first and second spools are usually contained in the case.

On the other hand, the transfer unit may or may not be contained in the case. Some transfer units are constantly exposed outside of the case via an opening formed in the case. Other transfer units are designed to be movable between the inside and outside of the case via the opening formed in the case. The transfer unit should be exposed to the outside of the case at least when the device for transferring a coated film having that transfer unit is in use because transferring the coated film to a desired surface is the essential feature of the transfer unit. This essential feature is ensured by keeping the transfer unit outside the case all the time or by making the transfer unit movable between the inside and outside of the case and exposing it outside when in use.

Regardless of whether the transfer unit is on the outside of the case or is movable between the inside and outside of the case, the device for transferring a coated film usually has a closure or a lid. The lid is for protecting the tape and the transfer unit by separating the latter from outside of the case. The lid serves to reduce the possibilities for the transfer unit that is positioned outside of the case to be broken by hitting against something or for the transfer unit and/or the tape to get dirty with dust or dirt. Typical lids are attached to the case in a removable or movable manner.

Although there is a variation of devices for transferring a coated film, the present applicant prefers using a transfer unit that is movable between the inside and outside of a case and a lid that is movable relative to the case.

Devices for transferring a coated film having a movable transfer unit are more complex in structure with a larger number of components and may sometimes be inferior in terms of costs than those having a fixed transfer unit. It is, however, easier for the former devices to achieve the desired purpose of protecting the transfer unit and the tape.

Likewise, devices for transferring a coated film having a lid that is movable relative to the case tend to be complicated in structure as compared with those having a lid that can be fitted to and removed from the case. The lid of the movable type, however, has no risk of being lost which otherwise can occur in lids of the removable type.

These favorable features account for why the present applicant prefers using the devices for transferring a coated film having a movable transfer unit and a movable lid.

In devices for transferring a coated film having a transfer unit that is movable between the inside and outside of the case and a lid that is movable relative to the case, the two components are moved: the transfer unit and the lid. Simultaneous movement of the transfer unit and the lid, if achieved, would be convenient for users.

Some approaches have already been proposed to implement such simultaneous movement.

A first approach is based on using a lid that is made of a flexible resin material. With this, the transfer unit is moved between the inside and outside of the case via an opening and, at the same time, the lid is moved between the closed position where the lid covers the opening and the open position where the opening is opened, when a user shift an operation member exposed to the outside of the case. The lid is flexible as described above, and is bent along the inner surface of the case during its movement from the closed position to the open position. The lid is housed in the case when it is in the open position.

A second approach is based on using a rotatable cap-type closure made of a hard material as a lid (Japanese patent laid-open No. 2011-121202). With this, the transfer unit is moved between the inside and outside of the case via an opening and, at the same time, the lid is rotated or turned between the closed position where the lid covers the opening and the open position where the opening is opened, when a user shifts an operation member exposed to the outside of the case. The lid stays outside of the case when it is in the open position.

The first approach requires, however, the lid made of a flexible resin material which often leads to an increase in costs of production. In addition, the flexible lid may become incapable of providing sufficient protection for the transfer unit due to the flexibility thereof when the lid is pressed from outside even when the lid is in the closed position covering the opening.

The second approach is free from the problem associated with the first approach because the lid is made of a hard material. However, the outside lid tends to be obstructive when it is in the open position, that is, when the device for transferring a coated film is in use. The lid is thus more likely to be damaged. Furthermore, the second approach is often suffered from higher costs due to a complex mechanism using, for example, a spring.

As described above, based on the premise of the simultaneous movement of the transfer unit and the lid of the device for transferring a coated film, there is no technique with which the transfer unit can be protected well enough, the lid is not obstructive during the use of the device, and costs of production can be kept low.

An object of the present invention is to provide a device for transferring a coated film in which a transfer unit can be protected well enough, a lid is not obstructive during the use of the device, and costs of production can be kept low, based on the premise that the transfer unit and the lid can be moved simultaneously.

BRIEF SUMMARY OF THE INVENTION

In order to solve the aforementioned problems, the present applicant proposes the following invention.

The present invention is a device for transferring a coated film comprising: a first spool on which a length of tape is wound, the tape having a coated film releasably disposed on one side thereof; a transfer unit for applying the coated film on the tape fed from the first spool to a desired surface to which the coated film is to be applied; a second spool adapted to take up the tape after the coated film is transferred by the transfer unit; a case for holding the first spool and the second spool, the case being adapted to receive the transfer unit, the case having an opening formed therein; and a lid attached to the case in such a manner that the lid can be rotated between a closed position where the lid covers the opening and an open position to open the opening.

An operation member is attached to the case of this device for transferring a coated film, the operation member being movable between a first position and a second position when shifted by a user; the lid being in the closed position and the transfer unit is held within the case when the operation member is in the first position, the lid being rotated to the open position and the transfer unit being moved to the outside of the case through the opening that is not covered when the operation member is moved to the second position; the lid being configured to move from over the opening to within the case when it is moved to the open position.

This device for transferring a coated film includes the operation member that can be moved between the first position and the second position. By moving this single operation member from the first position to the second position, the lid and the transfer unit can be moved simultaneously with, for example, a single operation. The movement of the lid is a rotational movement from the closed position to the open position while the movement of the transfer unit is the one from the inside to the outside of the case. When the operation member is moved from the second position to the first position, the lid and the transfer unit are moved in the opposite directions to those described above.

The lid that is rotated between the closed position and the open position can be made of a hard material. The material for the lid will neither cause any increase in costs nor make protection of the transfer unit insufficient.

In this device for transferring a coated film, the lid is located within the case when it is in the open position. Accordingly, when the lid is in the open position, that is, when the device for transferring a coated film is in use, the lid is not obstructive, which otherwise is not achieved with lids attached to the outside of the case.

In this way, in the device for transferring a coated film according to this application, the transfer unit can be protected well enough, the lid is not obstructive during the use of the device, and costs of production can be kept low, while the transfer unit and the lid can be moved simultaneously.

The operation member may be adapted to move parallel (move in a straight line without rotation) to the case. When the operation member is like the one just mentioned, the operation member may include a rack having rack teeth, the rack being in parallel with a direction of the parallel movement of the operation member. When the operation member is like the one just mentioned, the lid may include a pinion having pinion teeth capable of engaging with the rack teeth of the rack.

With the operation member including the rack and the lid includes the pinion, when the operation member is moved parallel to the case from the first position to the second position, the lid is moved from the closed position to the open position as a result of the rotation of the lid comprising the pinion having the pinion teeth engaging with the rack teeth of the rack that is moved in cooperation with the operation member.

In this way, by using a so-called rack-and-pinion mechanism, the rotation of the lid can be achieved easily.

As described above, the operation member may be adapted to move parallel to the case. When the operation member is like the one just mentioned, the operation member is connected to the transfer unit, and when the operation member is moved parallel to the case from the first position to the second position, the transfer unit may be moved from the inside to the outside of the case through the opening.

As described above, the operation member may be moved parallel to the case. In such situations, the parallel movement of the operation member can be converted into the motion of the transfer unit. Regardless of whether the operation member and the transfer unit are formed as a single component, they are integral with each other or joined together. The movement of the transfer unit can be achieved most readily when the transfer unit is configured to move in response to the movement of the operation member by the amount and in the direction equal to the amount and the direction of movement of the operation member.

The operation member is connected to the transfer unit via a plate-like main body, the main body being adapted to be attached with the first spool and the second spool. When the operation member is moved parallel to the case from the first position to the second position, the transfer unit, the first spool, and the second spool may be moved alongside each other with their relative position unchanged.

With this, the transfer unit can be moved in response to the movement of the operation member without changing the relative position among the transfer unit, the first spool and the second spool. A length of tape is passed between the first spool and the transfer unit as well as between the transfer unit and the second spool. The tape is typically tensioned appropriately. If the relative position among the transfer unit, the first spool and the second spool are not changed when the transfer unit is moved by moving the operation member, the tension on the tape will not be changed.

When the first spool and the second spool are moved without changing their relative position to the transfer unit in response to the movement of the operation member, the device for transferring a coated film according to this application may be as follows.

For example, the main body may be attached with a base end of a first shaft that supports the first spool as a rotation axis of the first spool. The case may have a first groove formed therein in parallel with the direction of the movement of the operation member, the first groove being adapted to receive and guide a tip of the first shaft that is moved collaterally along with the main body. With this, the first shaft can be moved collaterally in a stable manner with the tip thereof held within the first groove, so that the collateral movement of the main body can be stabilized. Alternatively, the main body may be attached with a base end of a second shaft that supports the second spool as a rotation axis of the second spool. The case may have a second groove formed therein in parallel with the direction of the movement of the operation member, the second groove being adapted to receive and guide a tip of the second shaft that is moved collaterally along with the main body. This also can provide effects similar to those described above. Of course, the holding of the tip of the first shaft within the first groove and the holding of the tip of the second shaft within the second groove may be used together.

In the device for transferring a coated film according to the present application, the movement of the operation member between the first position and the second position and the movement of the lid between the closed position and the open position may be completely cooperated with each other in such a manner that the lid is moved when the operation member is moved and the lid is not moved when the operation member is not moved.

The lid in the closed position serves to protect the transfer unit. In order to ensure the provision of this feature, the lid in the closed position should not be moved to the open position when a user does not intend so except that the user shifts the operation member from the first position to the second position. The aforementioned complete cooperation of the movement of the operation member and the transfer unit prevents the transfer unit from being moved unless the operation member is moved. This means, for example, the mass of the transfer unit is equivalent to the mass of the operation member and, in some cases, the masses of the main body connecting them and the first shaft, the first spool, the second shaft, and the second spool attached thereto. By increasing the mass of the transfer unit and increasing the inertia thereof, it is possible to reduce the possibility that the lid is rotated unintentionally. For example, when the device for transferring a coated film has the aforementioned rack-and-pinion mechanism, the movement of the lid can completely be cooperated with the movement of the operation member over the entire stroke of movement of the operation member between the first position and the second position as long as the rack teeth of the rack that is connected to the operation member is engaging with the pinion teeth of the pinion provided on the lid.

In order to prevent unintentional movement of the lid from the closed position to the open position more positively, the following measures may be taken for example. The operation member may be adapted to allow a user to move the operation member in parallel to the case with a smaller force only when the user performs a predetermined operation than in cases without such operation. This indicates that the operation member can be moved or becomes easier to be moved only when the user performs a predetermined operation to the operation member. To put it the other way around, unless the user performs the predetermined operation, the operation member is locked or cannot be moved without a large force. The lid is not rotated unless the operation member is moved, which means that the lid is not rotated or at least is hardly rotated unless the predetermined operation is made to the operation member. The predetermined operation is to shift the operation member to a direction that is different from the direction of movement of the operation member from the first position where the lid is in the closed position to the second position where the lid is in the open position, such as a direction perpendicular to the direction of movement thereof. For example, when the device for transferring a coated film is in a bag of the user, it rarely occurs that the operation member is touched with something in the bag and a force that moves the operation member from the first position to the second position and a force perpendicular to the direction of movement of the operation member are exerted on the operation member. Accordingly, the aforementioned configuration contributes to preventing unexpected or unintentional movement of the lid from the closed position to the open position.

DETAILED DESCRIPTION OF THE INVENTION

A preferred embodiment of the present invention is described with reference to the drawings.

Figure 1:
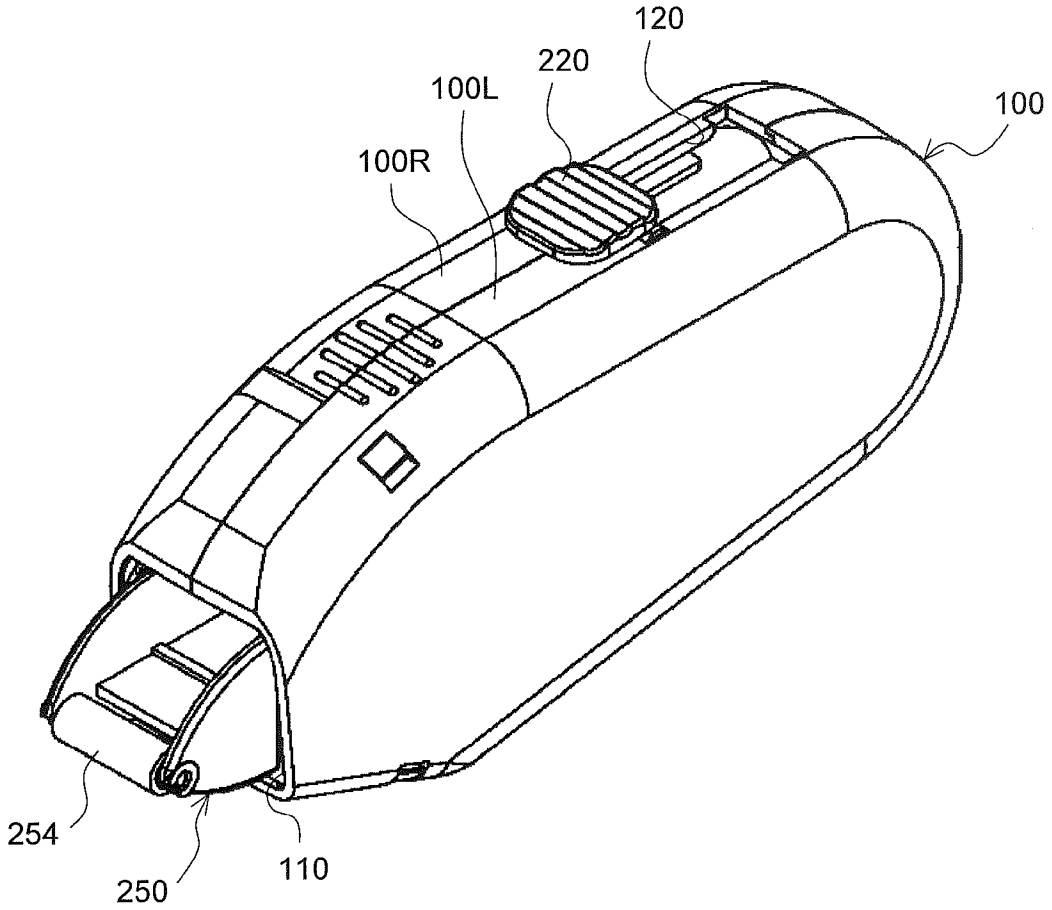
FIG. 1 is a perspective view of a device for transferring a coated film according to an embodiment of the present application with a lid thereof in an open position.
Figure 2:
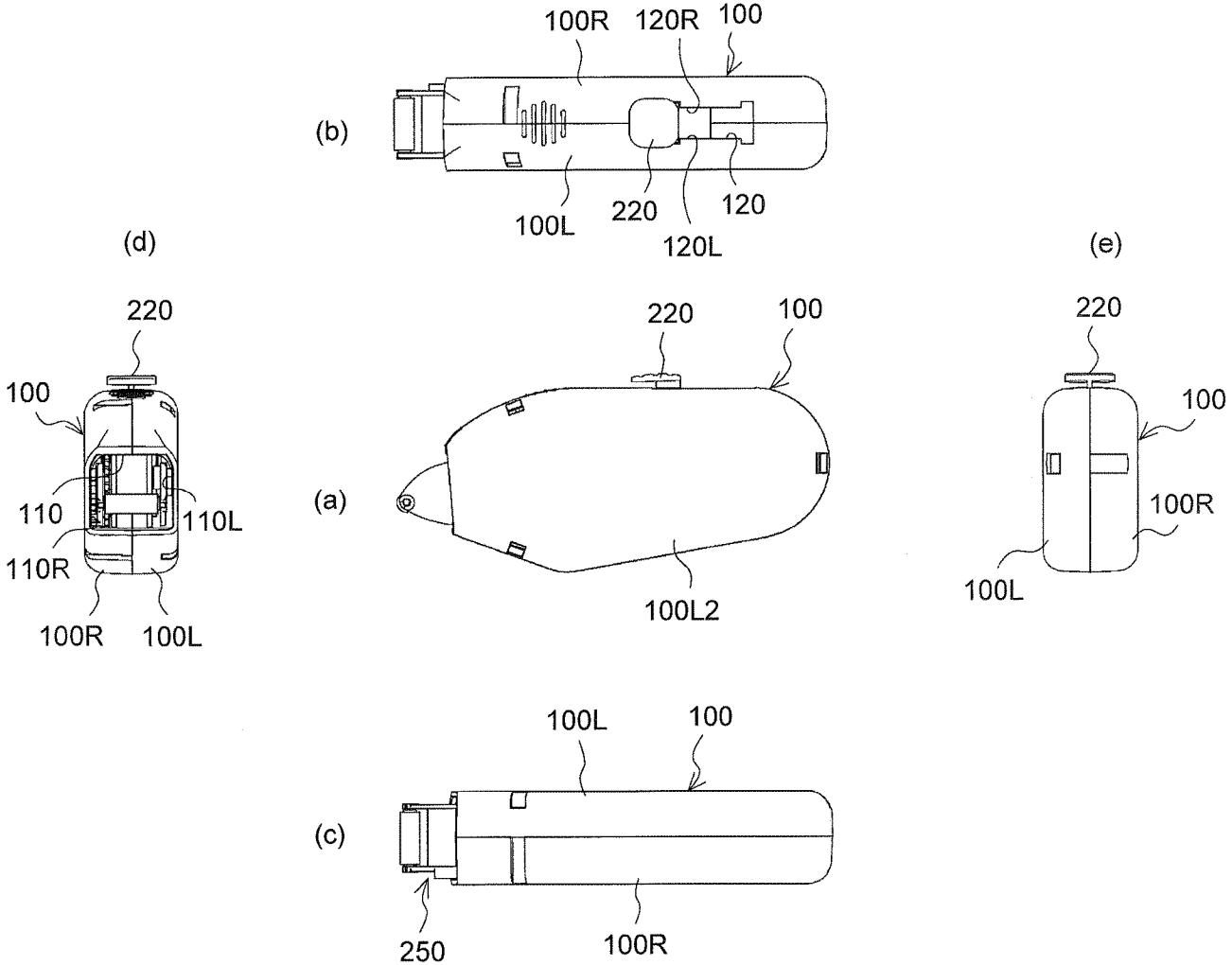
FIG. 2 is (a) a left side view, (b) a plan view, (c) a bottom view, (d) a front view, and (e) a back view of the device for transferring a coated film shown in FIG. 1.

An appearance of a device for transferring a coated film in this embodiment, more precisely, an appearance of the device in use is shown in a perspective view in FIG. 1 as well as five figures in FIG. 2. The device for transferring a coated film (hereinafter, also referred to as a "coated film transferring device") in this embodiment is an adhesive transfer device and the coated film disposed on a strip of tape is adhesive as described later, but not limited thereto.

This coated film transferring device includes a case 100. The case 100 is formed by joining two members both of which are made of a resin material. The case 100 is for holding, for example, first and second spools (which are described later) in it and thus generally consists of two or more separate components for convenience of assembly. Of course, how and in how many pieces is divided the case are not limited to those described in this embodiment where the case is divided into two halves.

In the following description, for the purpose of convenience, the members on the right and left sides when viewed from the above are referred to as right and left members 100R and 100L, respectively. Other right and left elements are herein termed likewise. The right member 100R and the left member 100L may be secured to each other using a known or well-known method. For example, they may be engaged with each other using a certain mechanism or bonded to each other using adhesive.

The case 100 is a hollow container in which the first and second spools described later are held. The first spool has an unused tape wound thereon as described later. The second spool is to take up a "used" tape, as described later. Structures and configurations of the tape, the first spool and the second spool can be similar to those known or well known in the field of coated film transferring devices.

An opening 110 is formed in the front of the case 100. The opening 110 has a generally rectangular shape, but not limited thereto. A guide slot 120 is formed in the top of the case 100 along the length thereof.

A sliding member which is described later is provided in the space within the case 100. A control piece 220 is provided above the sliding member in a manner described later. The control piece 220 is exposed on the case 100 through the guide slot 120.

A transfer unit 250 is provided in front of the sliding member. The transfer unit 250 has a function of transferring a coated film, which is adhesive herein, disposed on a tape described later to a desired surface where the coated film is to be transferred. The transfer unit 250 is housed within the case 100 when the coated film transferring device is not used. On the other hand, the transfer unit 250 is moved forward through the opening 110 and is projected out of the case 100 just before the coated film transferring device is used. FIG. 1 shows the coated film transferring device in which the transfer unit 250 is exposed outside the case 100.

The opening 110 can be closed by using a lid which is described later. The lid can be moved between a closed position where the lid covers the opening 110 and an open position where the opening 110 is open.

Figure 3:
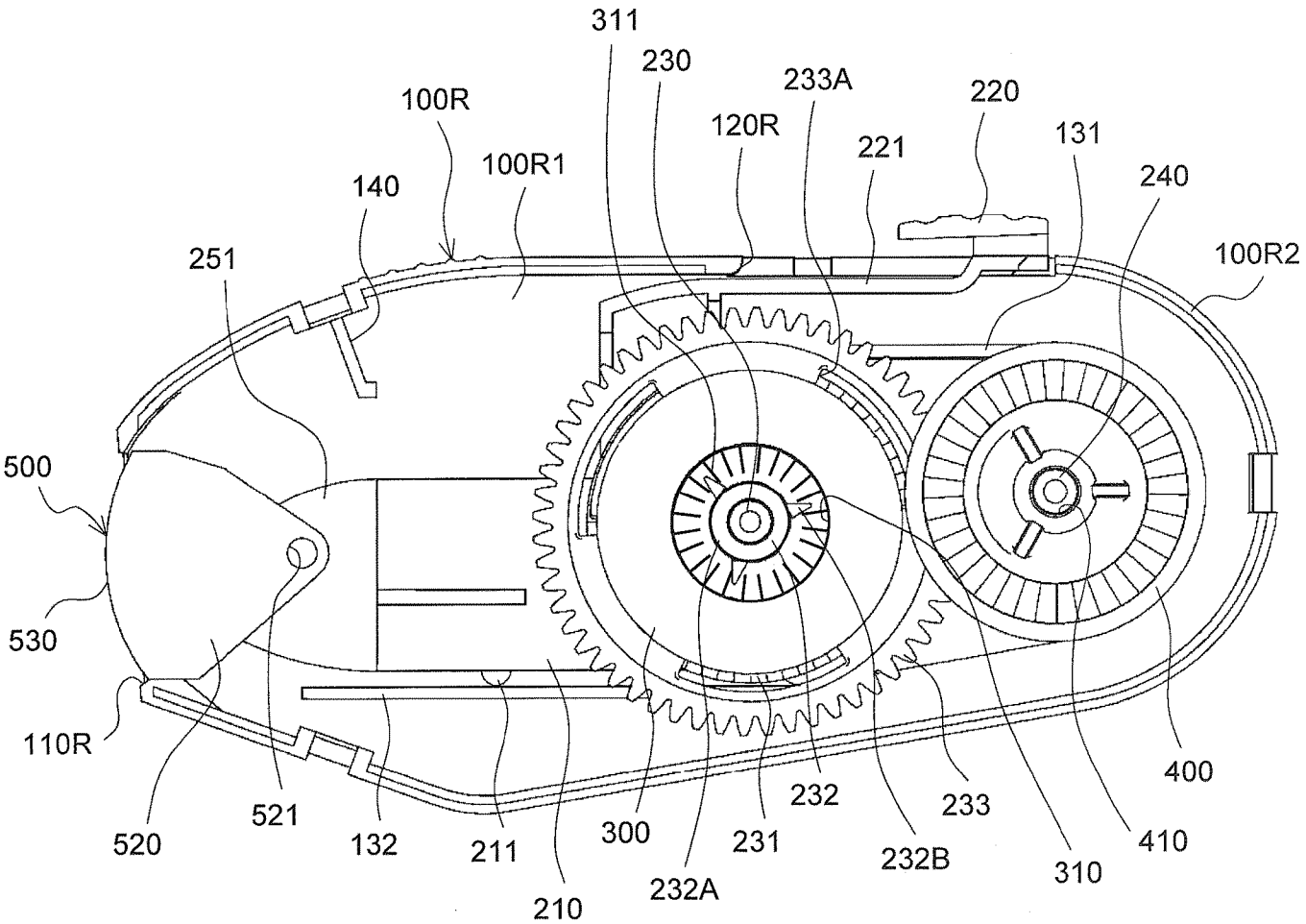
FIG. 3 is a left side view of the device for transferring a coated film shown in FIG. 1 without a left member, with the lid of the device in a closed position.

Referring to FIG. 3 which shows the coated film transferring device without the left member 100L, the structure of the coated film transferring device is described more in detail.

In the figures, 100R represents the right member. The right member 100R includes an oval-like panel 100R1 and a peripheral wall 100R2 having notches 110R and 120R. While only the right half of the case 100 is shown in FIG. 3, it should be understood that the left half also includes a similar oval-like panel and a similar peripheral wall having two notches. They are given the same reference numbers as the right counterparts except for the letter "L" used in place of the letter "R". The oval-like panel 100R1 has a generally elliptical shape and is relatively wide. The peripheral wall 100R2 embraces almost the entire circumference of the oval-like panel 100R1 and extends vertically from the oval-like panel 100R1, although the corner where the peripheral wall 100R2 meets the oval-like panel 100R1 is rounded.

The notch 110R has a generally rectangular shape and corresponds to a half of the opening 110. The notch 110R is formed in such a part of the peripheral wall 100R2 of the right member 100R that constitutes a front portion of the case 100 when the right and left members 100R and 100L are joined and held together. In other words, the notch 110R forms the opening 110 together with a notch 110L formed in a peripheral wall 100L2 of the left member 100L when the right and left members 100R and 100L are joined and held together. Since the opening 110 has a symmetrical shape and the right and left halves are mirror images, the notches 110R and 110L have the same size and are formed at positions corresponding to each other.

The notch 120R has a generally rectangular shape but is slightly wider at the front and rear ends thereof and corresponds to a half of the guide slot 120. The notch 120R is formed in such a part of the peripheral wall 100R2 of the right member 100R that constitutes an upper portion of the case 100 when the right and left members 100R and 100L are joined and held together. In other words, the notch 120R forms the guide slot 120 together with a notch 120L formed in the peripheral wall 100L2 of the left member 100L when the right and left members 100R and 100L are joined and held together. Since the guide slot 120 has a symmetrical shape and the right and left halves are mirror images, the notches 120R and 120L have the same size and are formed at positions corresponding to each other.

Guide rails 131 and 132 are provided on the inner surface of the oval-like panel 100R1 of the right member 100R. The guide rails 131 and 132 are projected from the inner surface of the oval-like panel 100R1 of the right member 100R and are disposed in a direction of movement of the sliding member described later. The guide rails 131 and 132 are for directing the sliding member. The sliding member directed by the guide rails 131 and 132 can move within the case 100 in the back-and-forth direction. The shape and size of each of the guide rails 131 and 132 taken perpendicular to the longitudinal direction thereof are the same at any point along its length, but not limited thereto. The guide rails 131 and 132 are rectangular in this embodiment, but not limited thereto.

A rib 140 is disposed on the inner surface of the peripheral wall 100R2 at a position ahead of the notch 120R in the right member 100R which corresponds to the right half of the guide slot 120. The rib 140 extends at generally right angles to the peripheral wall 100R2. The rib 140 is for preventing excessive rotation of a lid (described later) when the lid is at the open position.

How the guide rails 131 and 132 and the rib 140 work is described later.

A right lid shaft (not shown) is provided at right angles to the oval-like panel 100R1 on the inner surface of the oval-like panel 100R1 of the right member 100R at a lower position of the forward end to support the lid described later. Likewise, a left lid shaft (not shown) similar to the right lid shaft is provided at a lower position of the forward end of an oval-like panel 100L1 of the left member 100L to support the lid (i.e., a position corresponding to the position of the right lid shaft).

A sliding member 200 is attached to the right member 100R. The sliding member 200 is a single piece made of a resin material, but not limited thereto. Making the sliding member 200 as a single piece of a resin material leads to reducing the number of components used, which in turn helps keeping the costs of production of devices low.

Figure 5:
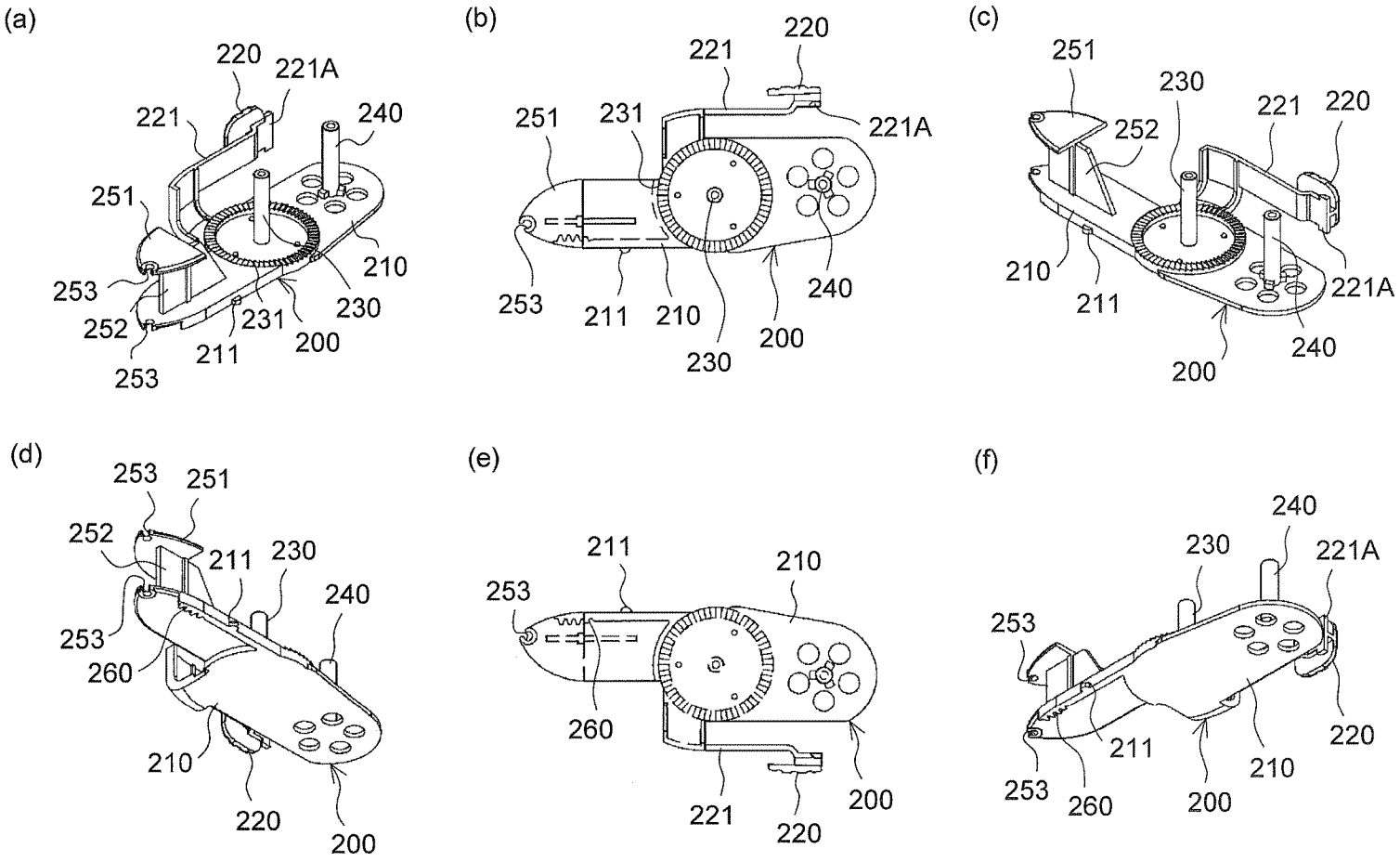
FIG. 5 is (a) a perspective view taken from lower left front, (b) is a side view taken from the left, (c) is a perspective view taken from lower left back, (d) is a perspective view taken from lower right front, (e) is a side view taken from the right, and (f) is a perspective view taken from lower right back of a sliding member included in the device for transferring a coated film shown in FIG. 1.

The sliding member 200 is configured as shown in FIG. 5. The sliding member has a main body 210, the aforementioned control piece 220, a first shaft 230 and a second shaft 240. The aforementioned transfer unit 250 is provided at a front part of the sliding member 200.

The main body 210 is a plate-like member as a whole which resembles a shape of an oval coin with the front part thereof narrower than the rear part thereof. The upper surface of the wider rear part of the main body 210 is adapted to contact with the lower surface of the guide rail 131. The lower surface of the wider rear part of the main body 210 is adapted to contact with the upper surface of the guide rail 132. In addition, a jut 211 projecting downward is provided on the lower surface of the narrower front part of the main body 210. The jut 211 is adapted to contact with the upper surface of the guide rail 132. The jut 211 serves to reduce friction between the guide rail 132 and the main body 210. As will be described below, the sliding member 200 is moved back and forth relative to the case 100. During this movement, the main body 210 is guided by the guide rails 131 and 132 extending along the direction of movement of the sliding member 200. The sliding member 200 having the main body 210 as a part thereof can be moved back and forth relative to the case 100 in a stable manner.

The control piece 220 has a rectangular shape and is connected to the main body 210 via a joint arm 221 formed by combining plate-like members. The right-to-left width of the control piece 220 is wider than the width of the aforementioned guide slot 120. A plate-like locking tab 221A is provided on the joint arm 221 near the junction between the joint arm 221 and the control piece 220. The plate-like locking tab 221A has a generally same width as the wider front and rear ends of the guide slot 120, and is parallel to the control piece 220. The width of the joint aim 221 is smaller than the width of the guide slot 120 at parts placed on the top of the locking tab 221A. The control piece 220 is thus supported by the joint arm 221 and positioned over the guide slot 120. Furthermore, the joint arm 221 has elasticity associated with the properties of a resin material forming it as well as the shape thereof. As described above, the control piece 220 is positioned over the guide slot 120 with a gap between the control piece 220 and the top of the case 100. In other words, the control piece 220 is slightly floated above (i.e., positioned higher than) the top of the case 100. The locking tab 221A is flush with the guide slot 120. The elasticity of the aforementioned joint arm 221 allows a slight movement of the control piece 220 towards the case 100. This means that a user can push the control piece 220 into the case 100 in use. With the control piece 220 not being held in the case 100, the locking tab 221A is engaged with one of the wider ends of the guide slot 120. In this state, the control piece 220 cannot be moved even if the user attempts to move it in the back-and-forth direction of the case 100 because of the locking tab 221A engaged with the wider end of the guide slot 120. When the user pushes the control piece 220 against the upper surface of the case 100, the locking tab 221A is disengaged from the wider end of the guide slot 120 and slips into the case 100. In this state, the control piece 220 can be moved back and forth.

In short, the presence of the aforementioned locking tab 221A and the elasticity of the joint arm 221 help make it possible to move the control piece 220 in this embodiment in the back-and-forth direction of the case 100 only when the control piece 220 is shifted in the direction that is different from the direction of its normal movement, i.e., only after the control piece 220 is pushed into the case 100. It is noted that, even without any push, the control piece 220 may be slipped into the case 100 if a large force is exerted on the control piece 220 and the locking tab 221A slides towards the wider rear end of the guide slot 120 when the locking tab 221A is in the wider front end thereof or slides towards the wider front end of the guide slot 120 when the locking tab 221A is in the wider rear end thereof. Accordingly, even with the locking tab 221A, this locking tab 221A may not enough to ensure perfect locking of the control piece 220 relative to the case 100 when the locking tab 221A is engaged with one of the wider front and rear ends of the guide slot 120 and the control piece 220 is not in the case 100. Even in such circumstances, the control piece 220 can be moved in the back-and-forth direction of the case 100 with a smaller force only when the control piece 220 is shifted in the direction that is different from the direction of its normal movement than in cases without such operation.

This indicates that, in this embodiment, the control piece 220 can be moved parallel to the case 100 with a smaller force only when a user shifts the control piece 220 in a predetermined manner than in cases without such predetermined operation. The predetermined operation in this embodiment is the push of the control piece 220 into the case 100. The predetermined operation is, however, not limited thereto and may be a movement other than the movement in parallel to the case 100 such as a movement of the control piece 220 in a widthwise direction of the case 100.

The first shaft 230 is for rotatably supporting the first spool. The second shaft 240 is for rotatably supporting the second spool. The first and second spools are described later.

Figure 6:
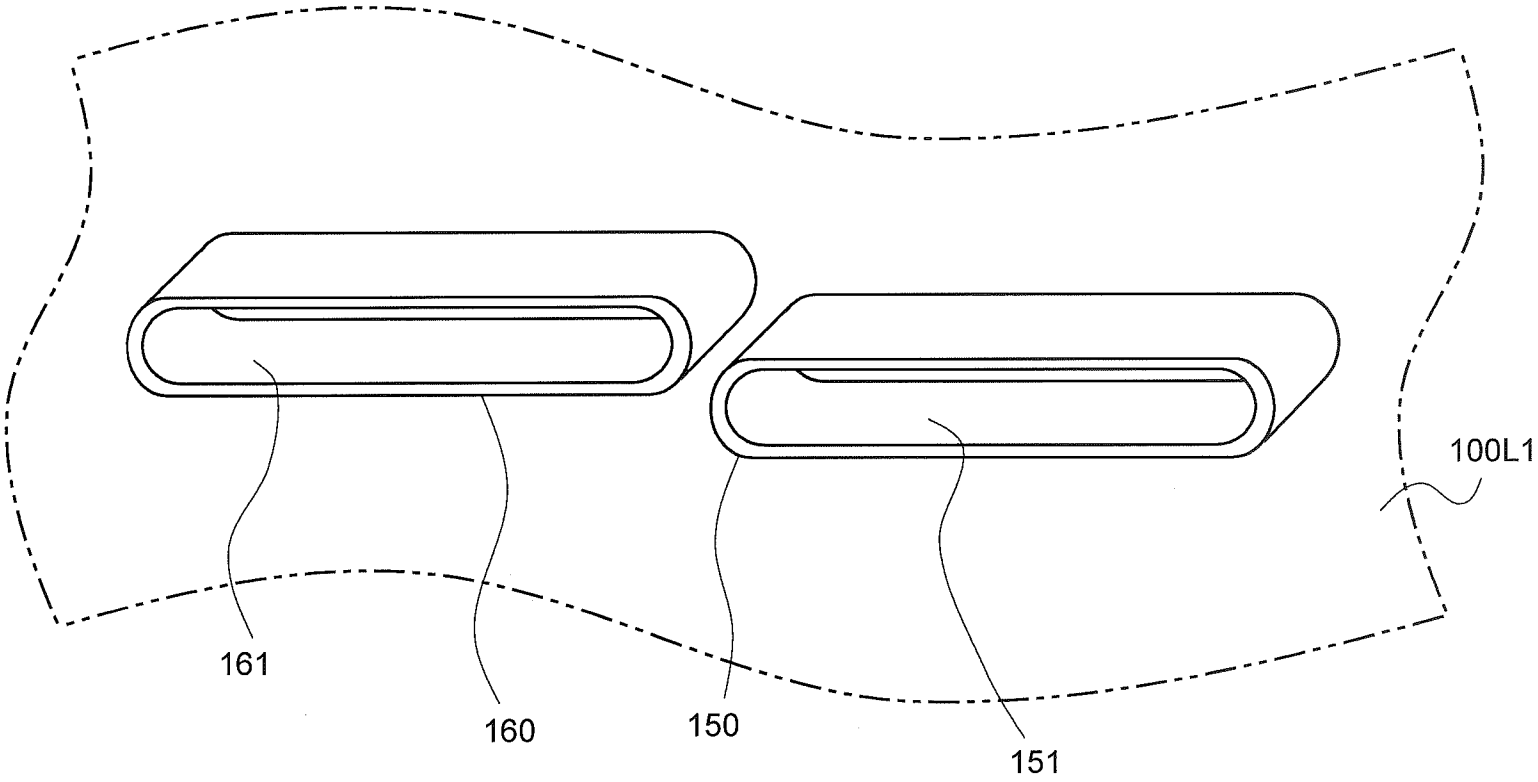
FIG. 6 is a perspective view of a rib disposed on the inner surface of the left member of the device for transferring a coated film shown in FIG. 1.

The first shaft 230 and the second shaft 240 are disposed perpendicular to the main body 210 of the sliding member 200. Each of the first shaft 230 and the second shaft 240 is a rod-shaped piece having a circular cross section. The length of each of the first shaft 230 and the second shaft 240 is generally equal to the width of the case 100. Two ribs 150 and 160 as shown in FIG. 6 are disposed on the inner surface of the oval-like panel 100L1 of the left member 100L of the case 100. Each of the ribs 150 and 160 has a shape of a flattened ellipse extending along the direction of movement of the sliding member 200. Grooves 151 and 161 are formed in the rib 150 and 160, respectively. The tips of the first shaft 230 and the second shaft 240 are held within the grooves 151 and 161, respectively, when the right and left members 100R and 100L are joined and held together. Upon movement of the sliding member 200, the first shaft 230 and the second shaft 240 are guided along the grooves 151 and 161, respectively, which further stabilize the movement of the sliding member 200. The first shaft 230 and the second shaft 240 also have a function of positioning the main body 210 of the sliding member 200 at a position close to the inner surface of the oval-like panel 100R1 of the right member 100R. As a result, the main body 210 is positioned correctly between the guide rail 131 and the guide rail 132.

Ratchet teeth 231 having one side inclined, which are known as being used in a ratchet mechanism, are formed around the first shaft 230 on the left surface of the main body 210. The ratchet teeth 231 are used to limit the rotation of a first gear described later in one direction.

A first rotation member 232 is attached to the first shaft 230. The first rotation member 232 has a hollow cylindrical part 232A and three plate-shaped vane-like projections 232B. The vane-like projections 232B are equally spaced from each other and extend radially outward from the wall of the hollow cylindrical part 232A. The first rotation member 232 is attached to the first shaft 230 with the first shaft 230 passed through the space in the hollow cylindrical part 232A and can be rotated about the first shaft 230.

A first gear 233 is attached to the first rotation member 232 at a position closer to the main body 210 in such a manner that the first gear 233 is coaxial with the hollow cylindrical part 232A. The first gear 233 can be rotated about the first shaft 230 along with the first rotation member 232. Three arcuate or bow-shaped bores 233A are formed in the first gear 233 along the circumference thereof. The bow-shaped bores 233A are formed at the positions corresponding to the ratchet teeth 231. The ends of each bow-shaped bore 233A are not engaged with the ratchet teeth 231 when the first gear 233 is rotated in the direction along the inclination of the ratchet teeth 231 but are engaged with the ratchet teeth 231 when the first gear 233 is rotated in the direction opposite to the inclination of the ratchet teeth 231. With this configuration, the first rotation member 232 is allowed to rotate only in one desired direction.

A first spool 300 (see, FIGS. 3 and 4) is attached to the first rotation member 232. The first spool 300 has a hollow cylindrical shape. A number of engagement teeth 311 are formed in an inner bore 310 in the first spool 300 in the direction parallel to the first shaft 230. The first spool 300 is attached to the first rotation member 232 without slipping by inserting the hollow cylindrical part 232A of the first rotation member 232 into the bore 310 in the first spool 300 with the three vane-like projections 232B received in appropriate spaces between the engagement teeth 311.

A length of tape 320 is wound on the first spool 300. The tape 320 may be a known or well-known product. A coated film, which is to be transferred and adhered to a desired surface positioned ahead of the transfer unit 250, is disposed on one side of the tape 320. The tape 320 in this embodiment is an adhesive layer, but not limited thereto. The adhesive layer is disposed only on one side of the tape 320 which is to be contacted with a desired surface by the transfer unit 250.

A second spool 400 is attached to the second shaft 240. The second spool 400 has a bore 410 passing through the center thereof. The bore 410 has a diameter corresponding to the diameter of the second shaft 240. The second spool 400 is rotatably attached to the second shaft 240 with the second shaft 240 passed through the bore 410.

While not being illustrated, a second gear (not shown) which is coaxial with the second spool 400 is attached to the second spool 400 at a position closer to the oval-like panel 100R1 of the right member 100R. The second gear is engaged with the aforementioned first gear 233. Accordingly, in response to the rotation of the first gear 233, the second gear rotates in the opposite direction to that of the first gear 233. This indicates that the rotation of the first spool 300 causes the second spool 400 to rotate in the opposite direction at a predetermined angular velocity relative to an angular velocity of the first spool 300.

The transfer unit 250 has a part of the forward end of the main body 210, an opposed plate 251, and a connector plate 252. The opposed plate 251 is, but not limited to, a plate having a similar streamline contour to that of the forward end of the main body 210 tapering to the forward end thereof. The connector plate 252 is a generally horizontal plate connecting the opposed plate 251 and the forward end of the main body 210. Bearing bores, 253 each having a concave shape, are formed in the respective forward ends of the main body 210 and the opposed plate 251.

A solid cylindrical roller 254 is rotatably connected to the bearing bores 253. More specifically, the roller 254 has shafts 254A coaxial with the roller 254 at both ends thereof. The shafts 254A are received by and held in the bearing bore 253 to connect the roller 254 to the bearing bores 253.

Figure 4:
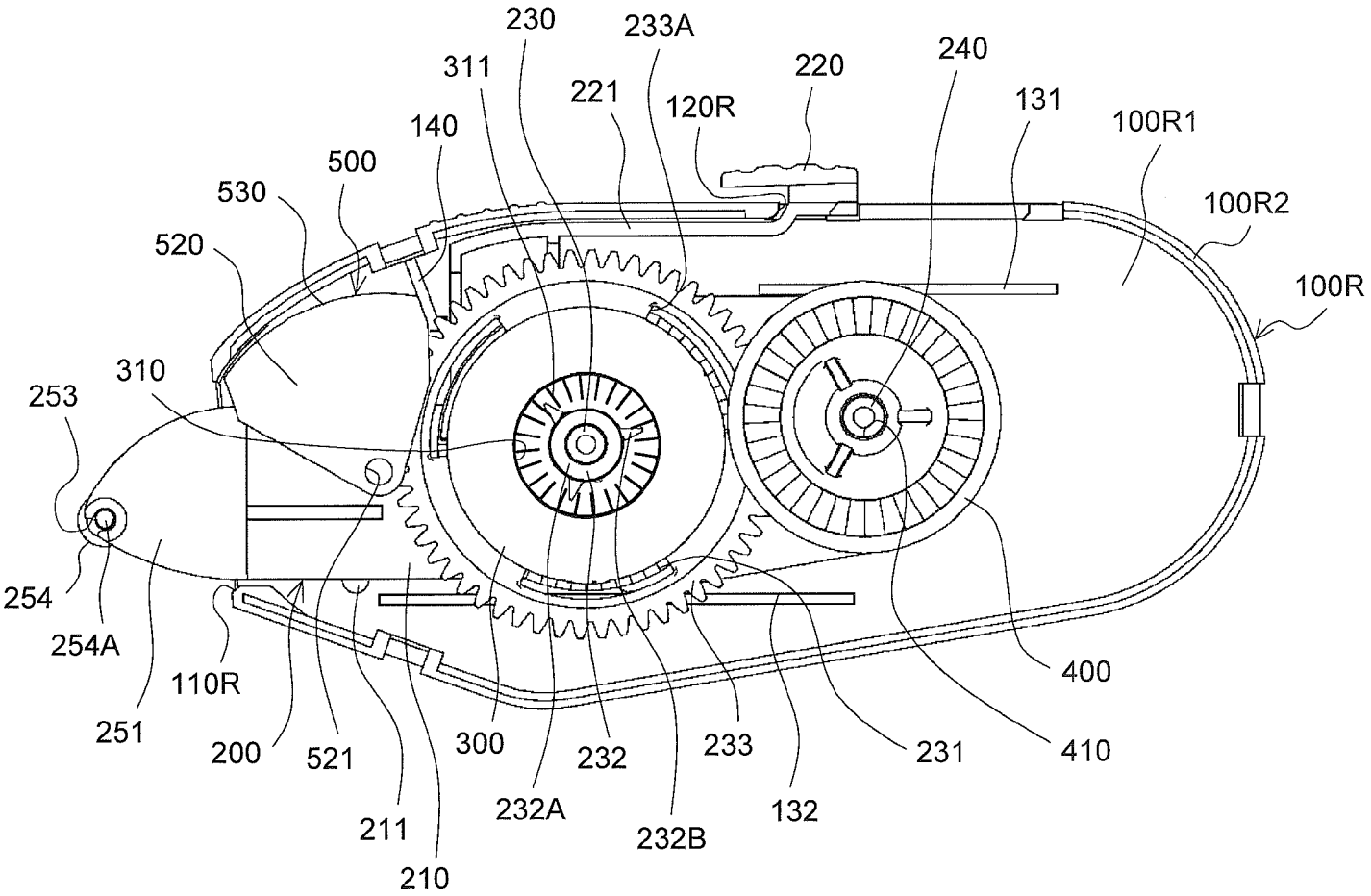
FIG. 4 is a left side view of the device for transferring a coated film shown in FIG. 1 without the left member, with the lid of the device in the open position.

While not illustrated in FIGS. 3 and 4, the aforementioned tape 320 is running from the first spool 300 to the second spool 400, in the middle of which the tape 320 is wrapped around the roller 254 with the adhesive layer facing outside. The tape 320 unwound from the first spool 300 reaches the roller 254 where the adhesive layer is transferred to a desired surface. The tape 320 after this transfer, that is to say, the used tape 320 reaches the second spool 400 and is taken up on the second spool 400.

A rack 260 is disposed on the surface of the main body 210 which is closer to the oval-like panel 100R of the right member 100R at a position near the forward end of the main body 210. The rack 260 has a plurality of ratchet teeth. The longitudinal direction of the rack 260 is coincident with the direction of movement of the sliding member 200.

Figure 7:
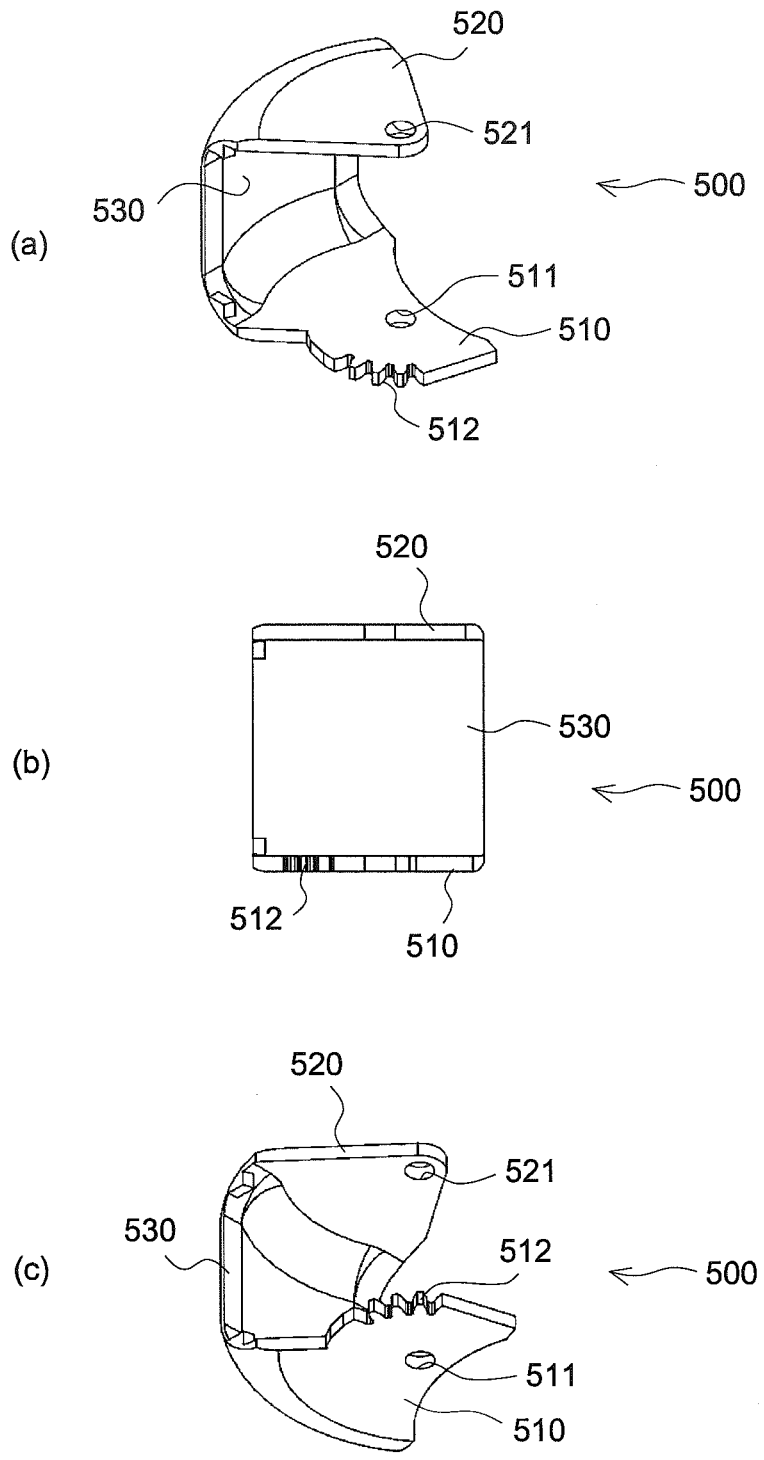
FIG. 7 is (a) a perspective view taken from the left, (b) a view showing a curved panel seen from inside, and (c) a perspective view taken from the right of the lid included in the device for transferring a coated film shown in FIG. 1.

A lid 500 is attached to the case 100. The lid 500 is shown on an enlarged scale in FIG. 7.

The lid 500 has a right side panel 510, a left side panel 520, and a curved panel 530. The right and left side panels 510 and 520 are a generally fan-shaped plate and are aligned in parallel with each other. The curved panel 530 connects curved or arcuate peripheries of the right and left side panels 510 and 520.

A right bearing bore 511 is formed in the right side panel 510 to receive the aforementioned right lid shaft. Likewise, a left bearing bore 521 is formed in the left side panel 520 to receive the aforementioned left lid shaft. The lid 500 is rotatably attached to the case 100 by means of fitting the right lid shaft into the right bearing bore 511 and fitting the left lid shaft into the left bearing bore 521.

A pinion 512 is provided on the lower part of the right side panel 510 in such a manner that the pinion 512 is positioned on an arc centered on a line connecting the right and left lid shafts. The pinion 512 has pinion teeth adapted to engage with the rack teeth of the aforementioned rack 260. The combination of the rack 260 and the pinion 512 forms a so-called rack-and-pinion mechanism and linear motion of the rack 260 in the longitudinal direction thereof results in rotational motion of the pinion 512. In other words, the lid 500 is rotated in response to the back-and-forth movement of the sliding member 200.

Method of use and operation of the aforementioned coated film transferring device are now described.

The coated film transferring device is in the state as shown in FIG. 3 when not in use. The lid 500 is in the closed position where it covers the opening 110.

In this state, the control piece 220 is located at its rearmost position in the guide slot 120 and, therefore, the sliding member 200 is located at the rearmost position in the case 100. The control piece 220 is slightly floated above the upper surface of the case 100 while the locking tab 221A is engaged with the wider rear end of the guide slot 120.

A user who intends to use the coated film transferring device holds it with, for example his or her four fingers other than the thumb, but not limited thereto, and pushes the control piece 220 against the upper surface of the case 100 using the thumb that is free. The locking tab 221A engaged with the members constituting the upper part of the case 100 in the wider rear end of the guide slot 120 is forced into the case 100. This results in disengagement of the locking tab 221A from the members constituting the upper part of the case 100. As a result, the control piece 220 becomes capable of moving forward along the guide slot 120.

The user slides the control piece 220 to the forward end of the case 100 while keeping the control piece 220 pressed against the upper surface of the case 100. The entire sliding member 200 having the control piece 220 is moved to the forward end of the case 100. Upon this movement, the upper end lower edges of the main body 210 of the sliding member 200 are guided by the guide rails 131 and 132, respectively, and the tips of the first shaft 230 and the second shaft 240 extending from the main body 210 are guided by the grooves 151 and 161 formed in the inner sides of the rib 150 and the rib 160, respectively, which stabilize the forward movement of the sliding member 200.

When the sliding member 200 is moved towards the forward end of the case 100, the rack 260 on the main body 210 is also moved forward. The pinion 512 having the pinion teeth engaging with the rack teeth of the rack 260 is then rotated and the lid 500 having the pinion 512 is flipped up.

After being rotated, the lid 500 is housed within the case 100 as shown in FIG. 4. The position of the lid 500 in this state corresponds to the open position to expose the opening 110. The pinion teeth of the pinion 512 and the rack teeth of the rack 260 are engaged with each other during the rotation of the lid 500. Since the lid 500 that is about to rotate excessively is abutted against the rib 140, excessive rotation of the lid 500 can be avoided absolutely by the rib 140.

During the rotation of the lid 500, the sliding member 200 continues to advance. The transfer unit 250 is shifted from the inside to the outside of the case through the opening 110 below the lid 500 that is being moved to the open position. As a result, when the control piece 220 is moved to the forefront position of the guide slot 120, the transfer unit 250 is advanced farther from the opening 110 formed in the case 100 as shown in FIG. 4, and is therefore exposed out of the case 100.

Regardless of the movement of the sliding member 200, the relative position among the first spool 300, the second spool 400 and the transfer unit 250 is not changed. The tension on the tape 320 is not also changed accordingly.

In this state, the coated film transferring device is now ready to be used by the user.

When the user releases his or her thumb from the control piece 220, the control piece 220 is returned to the slightly floated position above the upper surface of the case 100. In this state, the locking tab 221A is engaged with the wider front end of the guide slot 120, so that the control piece 220 does not move backward unless the user pushes the control piece 220 against the upper surface of the case 100.

Figure 8:
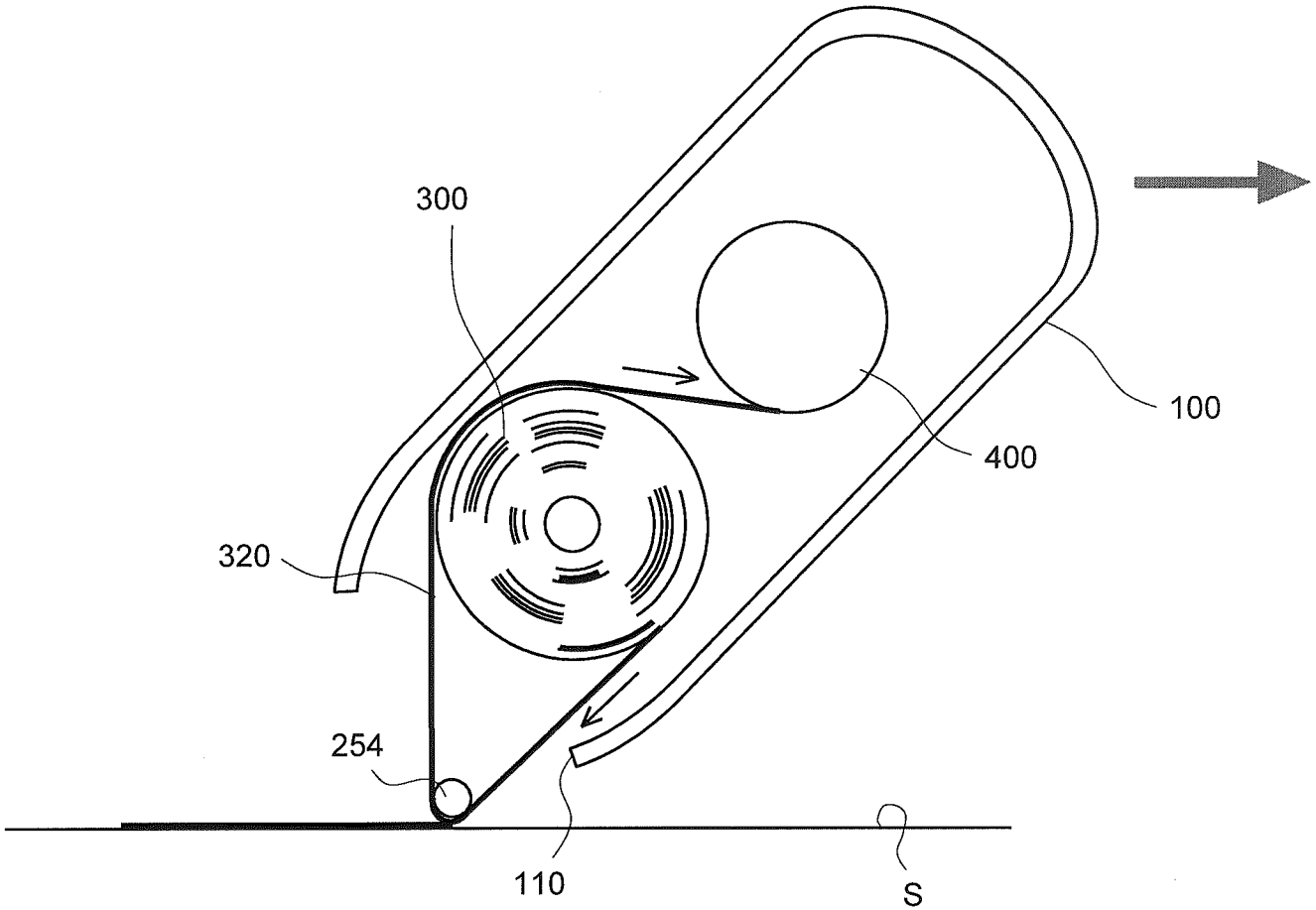
FIG. 8 is a side view schematically showing how to use the device for transferring a coated film shown in FIG. 1.

To use the coated film transferring device, the user holds it inclined as shown in FIG. 8 and moves the coated film transferring device backward as depicted by a thick arrow in the figure while pressing the roller 254 of the transfer unit 250 against a desired surface S. The adhesive layer on the tape 320 is pressed against the desired surface S through the tape 320 by the roller 254 and is transferred to the desired surface S.

The tape 320 is appropriately tensioned. When the tape 320 is moved around the roller 254, the entire length of the tape 320 is moved in the direction depicted by a thin arrow in FIG. 8. In response to the movement of the tape 320, the associated force is transmitted to the first spool 300. The first spool 300 is then rotated and the tape 320 is unwound from the first spool 300. On the other hand, the second spool 400, which is in a fixed relation to the first spool 300 and has the second gear engaging with the first gear 233 that is rotated in cooperation with the first spool 300, is rotated in the opposite direction to that of the first spool 300 to take up the used tape 320 from which the adhesive layer has already been transferred to the desired surface S. Since the direction of rotation of the first spool 300 is limited by the ratchet teeth 231, no rotation occurs in the opposite direction.

In this way, the user can transfer the adhesive layer to a desired part of the desired surface S.

When the user has finished using the coated film transferring device, he or she takes the following steps.

The user holds the coated film transferring device in hand and pushes the control piece 220 against the upper surface of the case 100. In response to this, the locking tab 221A that is engaged with the wider front end of the guide slot 120 and is engaged with the members constituting the upper part of the case 100 is slipped into the case 100. This releases the engagement between the locking tab 221A and the members constituting the upper part of the case 100. Then, the control piece 220 becomes capable of moving backward along the guide slot 120.

The user moves the control piece 220 towards the rear end of the case 100 while keeping the control piece 220 pressed against the upper surface of the case 100. The entire sliding member 200 having the control piece 220 is moved towards the rear end of the case 100. The upper and lower edges of the main body 210 of the sliding member 200 are guided by the guide rails 131 and 132, respectively, and the tips of the first shaft 230 and the second shaft 240 extending from the main body 210 are guided by the grooves 151 and 161 formed in the inner sides of the rib 150 and 160, respectively, as in the case of the forward movement of the sliding member 200.

When the sliding member 200 is moved towards the rear end of the case 100, the rack 260 on the main body 210 is also moved backward. The pinion 512 having the pinion teeth engaging with the rack teeth of the rack 260 is rotated and the lid 500 having the pinion 512 reaches the closed position as shown in FIG. 3. The pinion teeth of the pinion 512 and the rack teeth of the rack 260 are kept engaged until the rotation of the lid 500 is completed.

During the rotation of the lid 500, the sliding member 200 continues to recede. The transfer unit 250 is shifted from the outside to the inside of the case through the opening 110 below the lid 500 that is being moved to the closed position. When the control piece 220 is moved to the rearmost position of the guide slot 120, the transfer unit 250 is housed within the case 100 as shown in FIG. 3. Since the opening 110 in this state is covered with the lid 500, the transfer unit 250 and the tape 320 are protected by the lid 500 from, for example, dust present in the outside of the case 100.

In this state, the control piece 220 does not move forward unless the user pushes the control piece 220 against the upper surface of the case 100. Accordingly, even when the coated film transferring device is in a bag without being covered with anything, there is no possibility that the control piece 220 is touched with something in the bag and moved forward to move the lid 500 to the open position and to expose the transfer unit 250 and the tape 320 outside of the case 100.

The invention claimed is:

1. A device for transferring a coated film comprising:

a first spool on which a length of tape is wound, the tape having a coated film releasably disposed on one side thereof;

a transfer unit for applying the coated film on the tape fed from the first spool to a desired surface to which the coated film is to be applied;

a second spool adapted to take up the tape after the coated film is transferred by the transfer unit;

a case for holding the first spool and the second spool, the case being adapted to receive the transfer unit, the case having an opening formed therein; and a lid attached to the case in such a manner that the lid can be rotated between a closed position where the lid covers the opening and an open position to open the opening;

an operation member being attached to the case, the operation member being movable between a first position and a second position when shifted by a user;

the lid being in the closed position and the transfer unit is held within the case when the operation member is in the first position, the lid being rotated to the open position and the transfer unit being moved to the outside of the case through the opening that is not covered when the operation member is moved to the second position;

the lid being configured to move from over the opening to within the case when it is moved to the open position.

2. The device according to claim 1, wherein:

the operation member is adapted to move parallel to the case and comprises a rack having rack teeth, the rack being in parallel with a direction of the parallel movement of the operation member;

the lid comprises a pinion having pinion teeth capable of engaging with the rack teeth of the rack; and when the operation member is moved parallel to the case from the first position to the second position, the lid is moved from the closed position to the open position as a result of the rotation of the lid comprising the pinion having the pinion teeth engaging with the rack teeth of the rack that is moved in cooperation with the operation member.

3. The device according to claim 1, wherein:

the operation member is adapted to move parallel to the case;

the operation member is connected to the transfer unit; and when the operation member is moved parallel to the case from the first position to the second position, the transfer unit is moved from the inside to the outside of the case through the opening.

4. The device according to claim 3, wherein:

the operation member is connected to the transfer unit via a plate-like main body, the main body being adapted to be attached with the first spool and the second spool;

when the operation member is moved parallel to the case from the first position to the second position, the transfer unit, the first spool, and the second spool are moved alongside each other with their relative position unchanged.

5. The device according to claim 4, wherein:

the main body is attached with a base end of a first shaft that supports the first spool as a rotation axis of the first spool; and the case has a first groove formed therein in parallel with the direction of the movement of the operation member, the first groove being adapted to receive and guide a tip of the first shaft that is moved collaterally along with the main body.

6. The device according to claim 4, wherein:

the main body is attached with a base end of a second shaft that supports the second spool as a rotation axis of the second spool; and the case has a second groove formed therein in parallel with the direction of the movement of the operation member, the second groove being adapted to receive and guide a tip of the second shaft that is moved collaterally along with the main body.

7. The device according to claim 1, wherein:

the movement of the operation member between the first position and the second position and the movement of the lid between the closed position and the open position are completely cooperated with each other in such a manner that the lid is moved when the operation member is moved and the lid is not moved when the operation member is not moved.

8. The device according to claim 1, wherein:

the operation member is adapted to allow a user to move the operation member in parallel to the case with a smaller force only when the user performs a predetermined operation than in cases without such operation.

* * * * *